US006229516B1

(12) United States Patent
Kim et al.

(10) Patent No.: US 6,229,516 B1
(45) **Date of Patent: *May 8, 2001**

(54) DISPLAY A DRIVING CIRCUIT AND A DRIVING METHOD THEREOF

(75) Inventors: Dong-Gyu Kim, Suwon-ci; Tae-Sung Kim, Suwon-si; Sang-Soo Kim; Seung-Jun Lee, both of Seoul; Jung-Min Hu, Suwon-si, all of (KR)

(73) Assignee: Samsung Electronics Co., Ltd., Suwon (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/774,523

(22) Filed: Dec. 30, 1996

(30) Foreign Application Priority Data

Dec. 30, 1995 (KR) ..... 95-68232
Jul. 10, 1996 (KR) ..... 96-27722

(51) Int. Cl.[7] ..... G09G 3/36

(52) U.S. Cl. ..... 345/103; 345/99; 345/100; 345/213; 345/515

(58) Field of Search ..... 345/55, 98, 204, 345/80, 51, 99, 100, 103, 213, 515, 516, 517; 340/758

(56) References Cited

U.S. PATENT DOCUMENTS

| | | | | |
|---|---|---|---|---|
| 4,707,692 | * | 11/1987 | Higgins et al. | 340/805 |
| 4,739,320 | * | 4/1988 | Dolinar et al. | 340/781 |
| 4,797,667 | * | 1/1989 | Dolinar et al. | 345/76 |
| 4,837,566 | * | 6/1989 | Channing et al. | 340/781 |
| 5,049,865 | * | 9/1991 | Nakamura et al. | 340/758 |
| 5,093,655 | * | 3/1992 | Tanioka et al. | 340/784 |
| 5,206,634 | * | 4/1993 | Matsumoto et al. | 340/784 |
| 5,568,163 | * | 10/1996 | Okumura | 345/100 |
| 5,754,160 | * | 5/1998 | Shimizu et al. | 345/103 |
| 5,771,031 | * | 6/1998 | Kinoshita et al. | 345/98 |
| 5,801,672 | * | 9/1998 | Masuda et al. | 345/98 |
| 6,040,826 | * | 3/2000 | Furukawa | 345/196 |
| 6,094,243 | * | 7/2000 | Yasunishi | 349/33 |

* cited by examiner

*Primary Examiner*—Richard A. Hjerpe
*Assistant Examiner*—Henry N. Tran
(74) *Attorney, Agent, or Firm*—Jones Volentine, L.L.C.

(57) ABSTRACT

Two gate lines are applied with scanning signals simultaneously. The period of the scanning signal and the image signal being read from a frame memory is twice that of the image signal being written into a frame memory or that of the scanning signal of a conventional art. Therefore, the time for applying the image signal to the pixels increase twice. In addition, the image signals in a frame are continuously applied into the first row pixels to the last row pixels, and thus each row pixels have the same driving conditions.

6 Claims, 10 Drawing Sheets

DISPLAY A DRIVING CIRCUIT AND A DRIVING METHOD THEREOF

BACKGROUND OF THE INVENTION

1. Field of the Invention

The present invention relates to a driving circuit and a driving method for a display device.

2. Description of the Related Art

Flat panel displays (hereinafter referred to as FPDs) such as liquid crystal displays (hereinafter referred to as LCDs), plasma display panels (PDP), electroluminescences (ELs), field emission displays (FEDs) are used for displays such as computer monitors, instead of cathode ray tubes (CRT), which are heavy and consume a large amount of power. These FPDs have a plurality of pixels arranged in a matrix form.

The LCDs are representatives of the FDPs. Active matrix type LCDs, among the LCDs, using thin film transistors (hereinafter referred to TFTs) as switching elements are commonly used.

An LCD includes two panels and a liquid crystal between the two panels. One panel has a plurality of pixel electrodes, switching elements and wirings, and the other panel has a common electrode and color filters. A pixel electrode and a common electrode, along with the liquid crystal between the two electrodes, form a liquid crystal capacitor, and the potential difference between the two electrodes causes the molecules of the liquid crystal to be distorted, thereby rotating the polarization of incident light. A liquid crystal capacitor and a switching element form a pixel of an LCD, but only a pixel electrode and a switching element are often considered as components of a pixel.

Referring to FIG. 1, a conventional active matrix liquid crystal display and its driving circuit are described.

A plurality of pixels (not shown) driven by wirings are formed in a liquid crystal panel 1 into a matrix. The matrix of the pixels are named as the "pixel matrix", and a "pixel row" and a "pixel column" are terms meaning a row of the pixel matrix and a column of the pixel matrix respectively, in this specification and claims. In addition, the pixels of a pixel row and the pixels of a pixel column are defined as the "row pixels" and the "column pixels", respectively.

Examples of the wirings are scanning lines, or gate lines, $G_1, G_2, \ldots, G_{m-1}, G_m, G_{m+1}, \ldots, G_M$, which transmit scanning signals to the pixels, and image signal lines, or data lines, $D_1, D_2, \ldots, D_{2N}$, which transmit image signals or image data to the pixels. Each pixel is connected to one of the gate lines $G_1, \ldots, G_M$ and one of the data lines $D_1, \ldots, D_{2N}$, and is driven by the signals from the gate line and the data line. The number of the gate lines $G_1, \ldots, G_M$ is equal to that of the pixel rows, and the number of the data lines $D_1, \ldots, D_{2N}$ is the same as that of the pixel columns.

Generally, a pixel of an LCD further includes a storage capacitor having a large capacitance in order to keep data voltages charged in the liquid crystal capacitors. The data voltage is the potential of the pixel electrode with respect to the potential of the common electrode, that is, the potential difference between the two terminals of the liquid crystal capacitor. The storage capacitors are made in two types, a previous gate type and an independent wiring type. In the previous gate type, a terminal of the storage capacitor of a pixel is connected to a pixel electrode of the pixel, while the other terminal is connected to a previous gate line, which is a term meaning a gate line connected to the previous row pixels. The LCD of the previous gate type requires an additional wiring (not shown) called a storage gate line or a zero-th gate line for the first row pixels. The storage gate line is usually formed above the first gate line $G_1$, and a terminal of the storage capacitor of each first row pixel is connected to the storage gate line. The storage gate line is applied with a scanning signal or a common signal, which is applied to the common electrode. On the other hand, an LCD of the independent wiring type has a plurality of storage electrode lines (not shown) formed between the gate lines, and a terminal of each storage capacitor is connected to the storage electrode lines applied with the common signal.

The gate lines $G_1, \ldots, G_M$ are arranged in a transverse direction on the panel 1 and are connected to a gate driver 20. The data lines $D_1, \ldots, D_{2N}$ are longitudinally formed on the panel 1 and are connected to upper and lower data drivers 12 and 14. The data drivers 12 and 14 are positioned at the upper and the lower parts of the panel 1, respectively. The odd data lines $D_1, D_3, \ldots, D_{2N-1}$ are connected to the lower data driver 14, while the even data lines $D_2, D_4, \ldots, D_{2N}$ connected to the upper data driver 12. The data drivers 12 and 14 are connected to a controller 100.

A conventional driving method of the conventional LCD shown in FIG. 1 is now described.

When input image data from outside enter the controller 100, the controller 100 sends the image data corresponding to the odd column pixels to the lower data driver 14 and those corresponding to the even column pixels to the upper data driver 12.

When a start signal STV is applied to the gate driver 20, the gate driver 20 supplies a scanning signal to the first gate line $G_1$, thereby turning on switching elements (not shown) connected to the first gate line $G_1$. Then, the upper data driver 12 and the lower data driver 14 apply the image data to the first row pixels via the data lines $D_1, \ldots, D_{2N}$.

When the application of the scanning signal for the first gate line $G_1$ is finished, a scanning signal is applied to the second gate line $G_2$. Then, since the switching elements of the first row pixels are turned off and the switching elements of the second row pixels are turned on, the image data corresponding to the second row pixels are applied to the second row pixels.

By way of the above described method, the pixel rows are sequentially scanned from the first pixel row to the last pixel row. When the scanning of the last pixel row is completed, that is, scanning for a frame is completed, the scanning signal is applied to the first gate line $G_1$ again and so the next frame begins.

However, since the more gate lines become required as the resolution of the display becomes higher, while the time required for one frame scanning remains limited, the time for scanning of one pixel row is reduced. Furthermore, as the size of the screen becomes larger, the lengths of the data lines become longer and thus the RC delay becomes larger. Accordingly, the image quality becomes worse.

SUMMARY OF THE INVENTION

An object of the present invention is to increase the time for scanning of one pixel row.

Another object of the present invention is to apply scanning signals continuously and sequentially, thereby preventing deterioration of the image quality.

A matrix type display according to the present invention includes a plurality of pixels, scanning lines or gate lines and image signal lines or data lines. The pixels, the scanning lines and the image signal lines are grouped into a plurality of pixel groups, a plurality of scanning line groups, a plurality of image signal line groups, respectively. The pixels of one pixel group are connected to the scanning lines of one scanning line group and to the image signal lines of one image signal line group, and the pixels of different pixel groups are connected to the image signal lines of different scanning line groups and to the image signal lines of different data line groups. Therefore, a scanning line group and a data line group define a pixel group.

According to the embodiment of the present invention, the number of the pixel groups is two, and one of the pixel groups is consisting of upper pixels formed in an upper part of a panel, while the other consisting of lower pixels formed in a lower part of the panel. Therefore, the scanning lines are grouped into upper scanning lines connected to the upper pixels and lower scanning lines connected to the lower pixels. Similarly, the image signal lines are grouped into upper image signal lines connected to the upper pixels and lower image signal lines connected to the lower pixels.

It is preferable that the upper and the image signal lines are arranged near the boundary of the upper part and the lower part of the panel such that the signals of the upper and the lower image signal lines have the same electrical load.

In order to drive the above-described LCD, at least two signal lines are scanned simultaneously. When using a memory for storing image data from outside, the reading speed of image data from the memory is slower than the writing speed of the image data into the memory.

Therefore, the time for applying the image data increases compared with a conventional method, provided the period of one frame is fixed.

Furthermore, the image data of a frame are continuously and sequentially applied to the pixels from the first pixel row to the last pixel row in order to make the driving conditions of the pixels same.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE PREFERRED EMBODIMENTS

The preferred embodiments of the present invention will become apparent from a study of the following detailed description, when viewed in light of the accompanying drawings.

Figure 1:
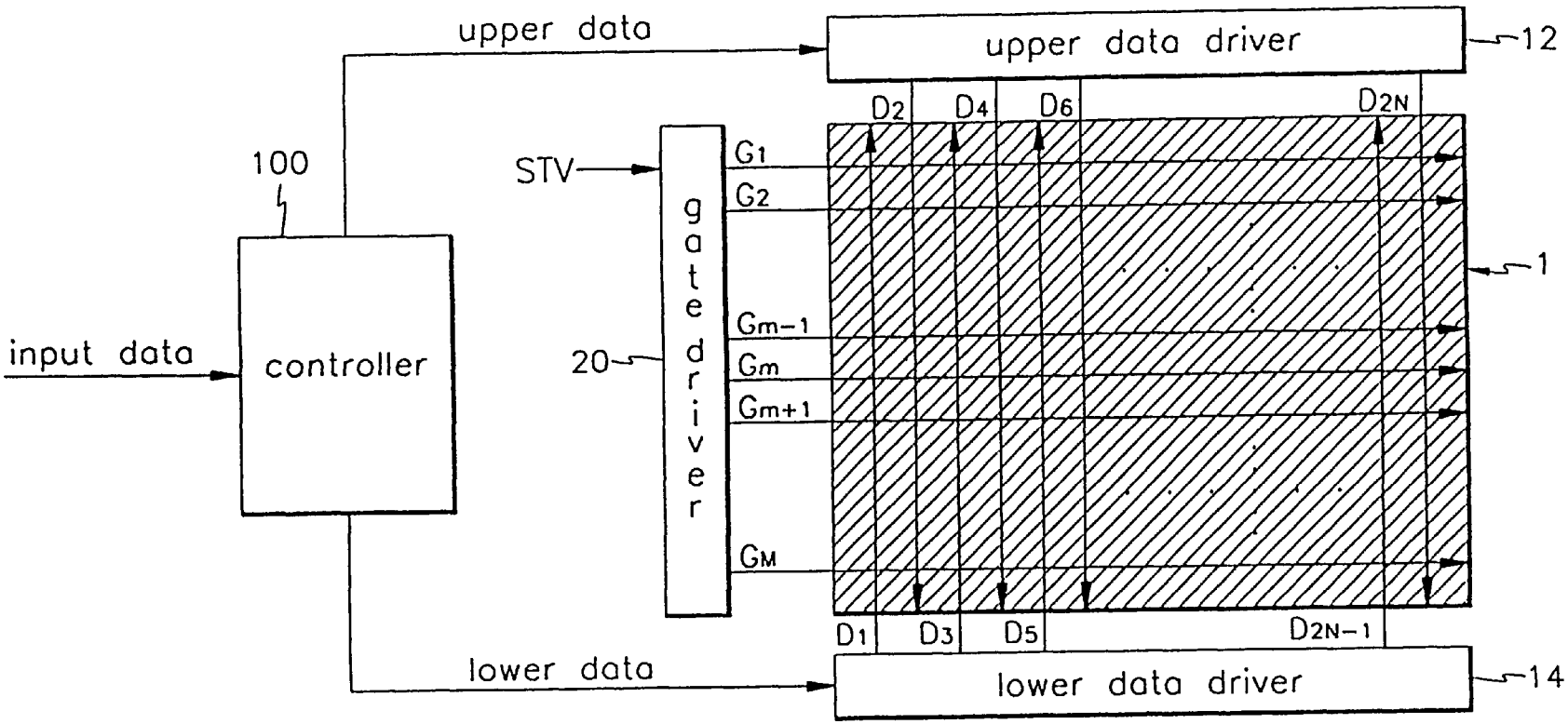
FIG. 1 Prior Art
FIG. 1 is a block diagram showing a conventional liquid crystal display and a driving circuit thereof.
Figure 2:
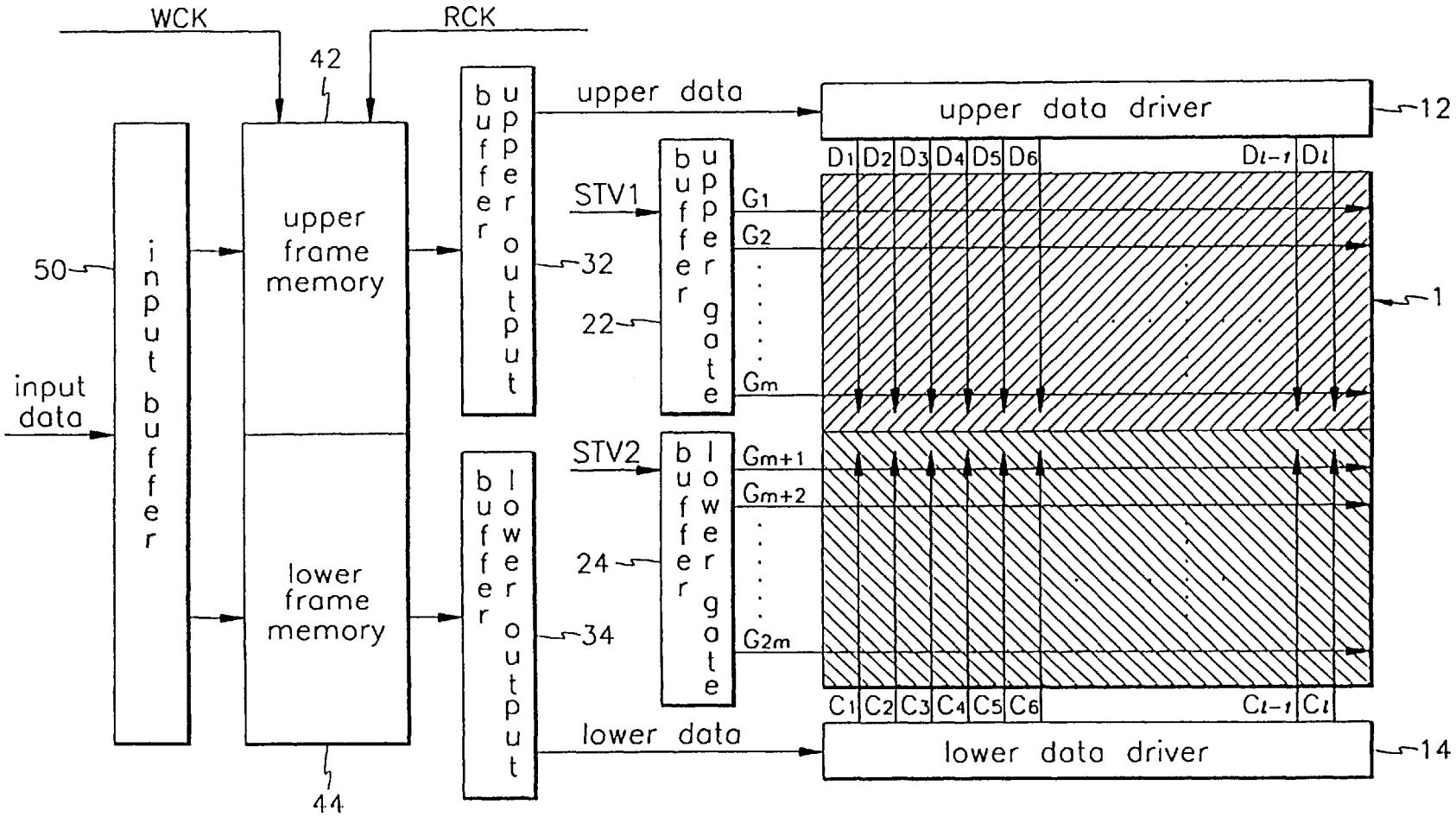
FIGS. 2 and 3 are block diagrams showing liquid crystal displays and driving circuits thereof according to the embodiments of the present invention.
Figure 3:
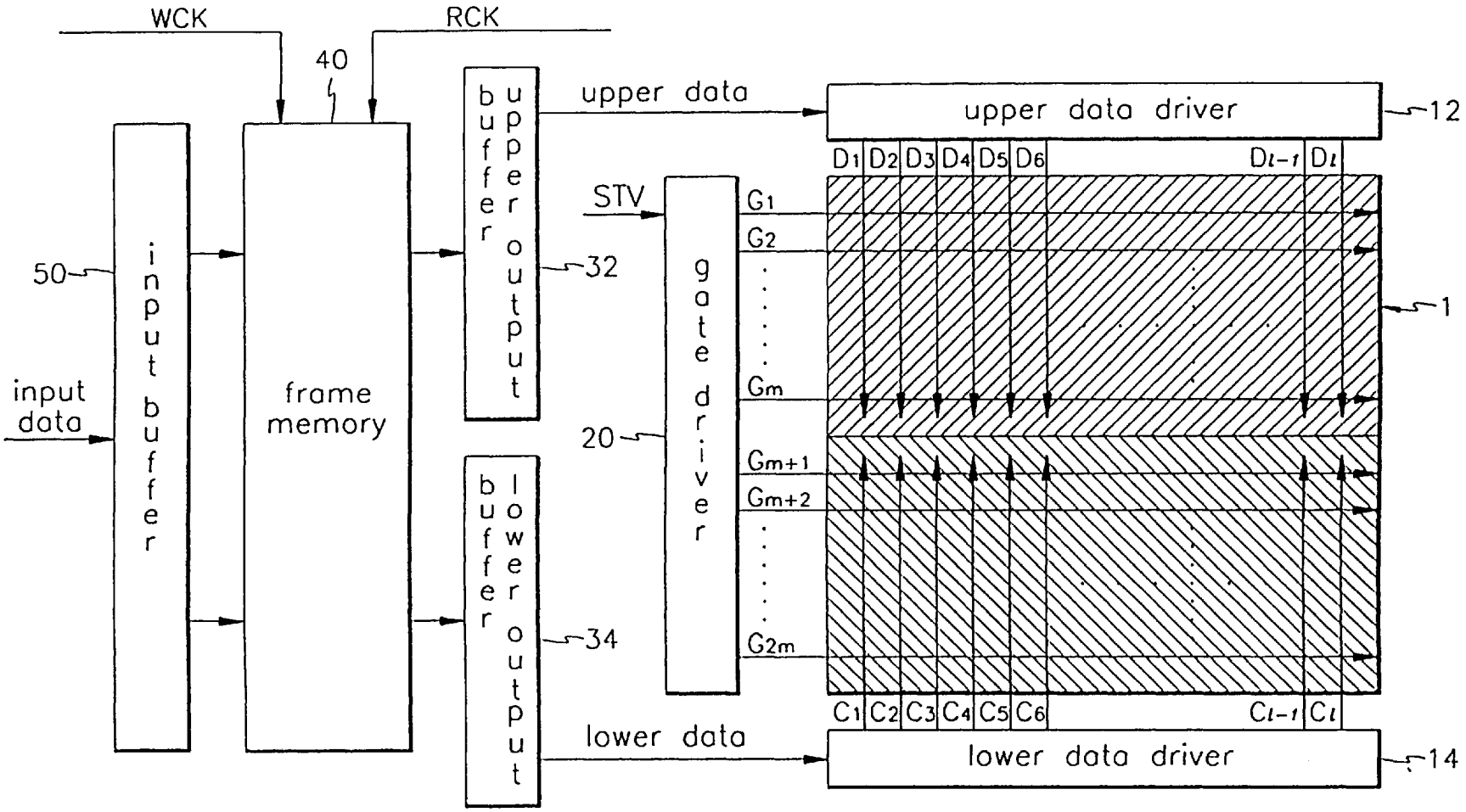

FIGS. 2 and 3 is a block diagram showing a liquid crystal display and a driving circuit thereof according to the embodiments of the present invention.

As shown in FIG. 2, 2m gate lines $G_1, \ldots, G_{2m}$ formed in a transverse direction on a liquid crystal panel 1 are grouped into an upper gate lines $G_1, \ldots, G_m$ placed in an upper portion of the panel 1, and an lower gate lines $G_{m+1}, \ldots G_{2m}$ placed in a lower portion of the panel 1. The number of the upper gate lines $G_1, \ldots, G_m$ and that of the lower gate lines $G_{m+1}, \ldots, G_{2m}$ are the same. The upper gate lines $G_1, \ldots, G_m$ and the lower gate lines $G_{m+1}, \ldots, G_{2m}$ are connected to an upper gate driver 22 and a lower gate driver 24, respectively.

Data lines $C_1, \ldots C_i$, and $D_1, \ldots, D_i$ are longitudinally arranged in the panel 1. A plurality of pixels (not shown, but shown in FIGS. 4 to 7) connected to the upper gate lines $G_1, \ldots, G_m$ (hereinafter referred to as upper pixels) are connected to an upper data lines $D_i, \ldots, D_i$, while a plurality of pixels (not shown) are connected to the lower gate lines $G_{m+1}, \ldots, G_{2m}$ (hereinafter referred to as lower pixels) are connected to a lower data lines $C_i, \ldots, C_i$. For example, the upper pixels in the first column are connected to the first upper data line $D_1$, while the lower pixels in the first column are connected to the first lower data line $C_1$. The upper data lines $D_1, \ldots, D_i$ are connected to an upper data driver 12, while the lower data lines $C_1, \ldots, C_i$ are connected to an upper data driver 14. Each pixel is connected to only one gate line and one data line.

The upper and the lower data drivers 12 and 14 are connected to upper and lower frame memories 42 and 44 via upper and lower output buffers 32 and 34 respectively. Input terminals of the upper and the lower frame memories 42 and 44 are connected to an input buffer 50. Although the LCD uses two frame memories in FIG. 2, it may use only one frame memory.

An LCD shown in FIG. 3 is different from the LCD shown in FIG. 2 in that it use only one gate driver 20 and one frame memory 40. That is, the upper and the lower gate lines $G_1, \ldots, G_{2m}$ are connected to a single gate driver 20, and the upper and the lower data drivers 12 and 14 are connected to a single frame memory 40 via the upper and the lower output buffers 32 and 34.

Next, the arrangement of the upper data lines and the lower data lines near the boundaries of them are considered. For convenience, it is described in case that m=2 for one upper data line and one lower data line.

First, previous gate type examples are described with reference to FIGS. 4 and 5.

Figure 4:
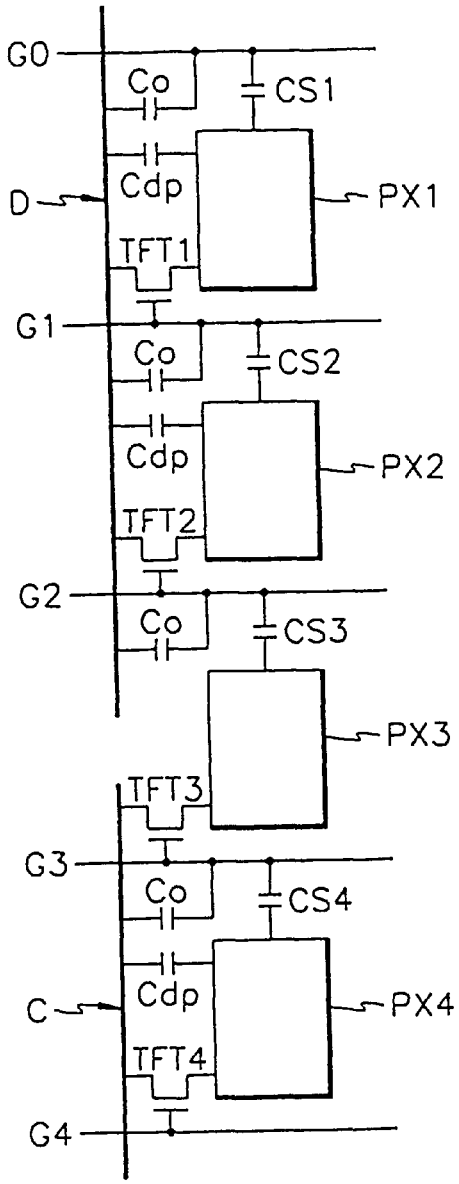
FIGS. 4 to 7 are equivalent circuit diagram illustrating liquid crystal displays according to the embodiments of the present invention.

As shown in FIG. 4, upper gate lines, i.e., the first and the second gate lines $G_1$ and $G_2$, and lower gate lines, i.e., the third and the fourth gate lines $G_3$ and $G_4$ are arranged in the transverse direction. An upper data line D and a lower data line C cross the gate lines $G_1$, $G_2$, $G_3$ and $G_4$ in the longitudinal direction. A storage gate line $G_0$ which is applied with a scanning signal, and is used for forming storage capacitors is transversely formed above the first gate line $G_1$.

Each pixel has a pixel electrode PX1, PX2, PX3 or PX4, a storage capacitor CS1, CS2, CS3 or CS4, and a switching element such as a thin film transistor TFT1, TFT2, TFT3 or TFT4. As described above, the pixel electrode PX1, PX2, PX3 or PX4 combined with a common electrode (not shown) of an opposite panel (not shown) as well as a liquid crystal therebetween forms a liquid crystal capacitor. The upper pixels, i.e., the first and the second row pixels are connected to one of the upper gate lines $G_1$ and $G_2$ and to the upper data line D via the switching elements TFT1 and TFT2, respectively. The lower pixels, i.e., the third and the fourth row pixels are connected to one of the lower gate lines $G_3$ and $G_4$ and to the lower data line C via the switching elements TFT3 and TFT4, respectively. In detail, a gate electrode of the switching element TFT1, TFT2, TFT3 or TFT4 is connected to one of the gate lines $G_1$, $G_2$, $G_3$ and $G_4$, its source electrode connected to one of the data lines D and C, and its drain electrode connected to one of the pixel electrodes PX1, PX2, PX3 and PX4. The switching element is turned on or off responding to the scanning signal from the gate line, and it transmits the image signal from the data line to the pixel electrode in its on state. Each pixel electrode PX1, PX2, PX3 or PX4 is connected to the previous gate line $G_0$, $G_1$, $G_2$ or $G_3$ via each storage electrode CS1, CS2, CS3 or CS4.

The upper data line D crosses the storage gate line Go and the upper gate lines $G_1$ and $G_2$, while the lower data line C crosses the lower gate lines $G_3$ and $G_4$. In addition, the upper data line D is adjacent to the pixel electrodes PX1 and PX2 of the upper pixels, and the lower data line C is adjacent to the pixel electrodes of the lower pixels except the first row pixels among the lower pixels, namely, adjacent to the pixel electrode PX4 of the fourth row pixel.

Concerning the capacitance contributing to the RC delay of the image signals flowing along the data lines, the gate lines and the pixel electrodes form capacitors by interacting the data lines D and C. Examples are gate capacitances $C_0$ due to the overlap of the data lines and the gate lines, pixel electrode capacitances $C_{dp}$ due to the overlap of the data lines and the pixel electrodes, and capacitances between the data lines and a common electrode of the other panel and between the data lines and the switching elements. Among them, the gate capacitances $C_0$ and the pixel electrode capacitances $C_{dp}$ are significant. For convenience, a capacitor and its capacitance are represented as the same reference numeral.

First, consider the capacitance affecting the image signal of the upper data line D. Since the upper data line D cross three gate lines $G_0$, $G_1$ and $G_2$, and is adjacent to two pixel electrodes PX1 and PX2 to form the pixel electrode capacitors $C_{dp}$, the capacitance is $(3\ C_0+2\ C_{dp})$ However, since the lower data line C cross two gate lines $G_3$ and $G_4$, and is adjacent to one pixel electrode PX4 to form the pixel electrode capacitors $C_{dp}$, the capacitance is $(2\ C_0+C_{dp})$. Therefore, the capacitances affecting the image signals of the upper data line D and the lower data line C are different. Accordingly, the RC delays in the two image signals are different and hence the voltages charging the upper pixel and the lower pixel are different, even though the magnitude of the two signals is the same.

Figure 5:
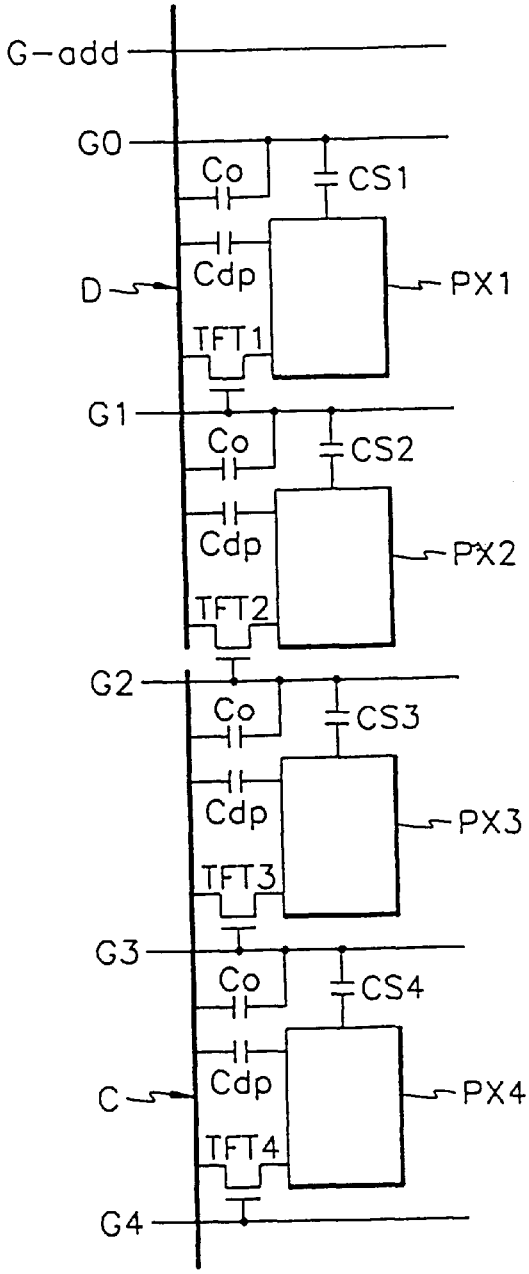

In order to remove this problem, an additional gate line $G_{add}$ applied with a scanning signal is transversely formed above the storage gate line $G_0$ and crosses the upper data line D, as shown in FIG. 5. In addition, the last gate line of the upper gate lines $G_1$ and $G_2$, i.e., the second gate line $G_2$, crosses the lower data line C instead of crossing the upper gate line D. As a result, the upper gate line D crosses the upper gate lines except the last gate line, the storage gate line $G_0$ and the additional gate line $G_{add}$, while the lower gate line crossing the lower gate lines $G_3$ and $G_4$ and the last gate line $G_2$ of the upper gate lines. Furthermore, the pixel electrodes PX1 and PX2 of the upper pixels are adjacent to the upper data line D, and the pixel electrodes PX3 and PX4 of the lower pixels are adjacent to the lower data line C.

Accordingly, the upper data line D crosses three gate lines $G_{add}$, $G_0$ and $G_1$ and is adjacent to two pixel electrodes PX1 and PX2 to form the pixel electrode capacitors, and the lower data line C crosses three gate lines $G_2$, $G_3$ and $G_4$ and is adjacent to two pixel electrodes PX3 and PX4. The capacitances of the image signal of the upper and the lower data lines D and C become $(3\ C_0+2\ C_{dp})$ and thus they are equal to each other.

Next, independent wiring type examples are described with reference to FIGS. 6 and 7.

Figure 6:
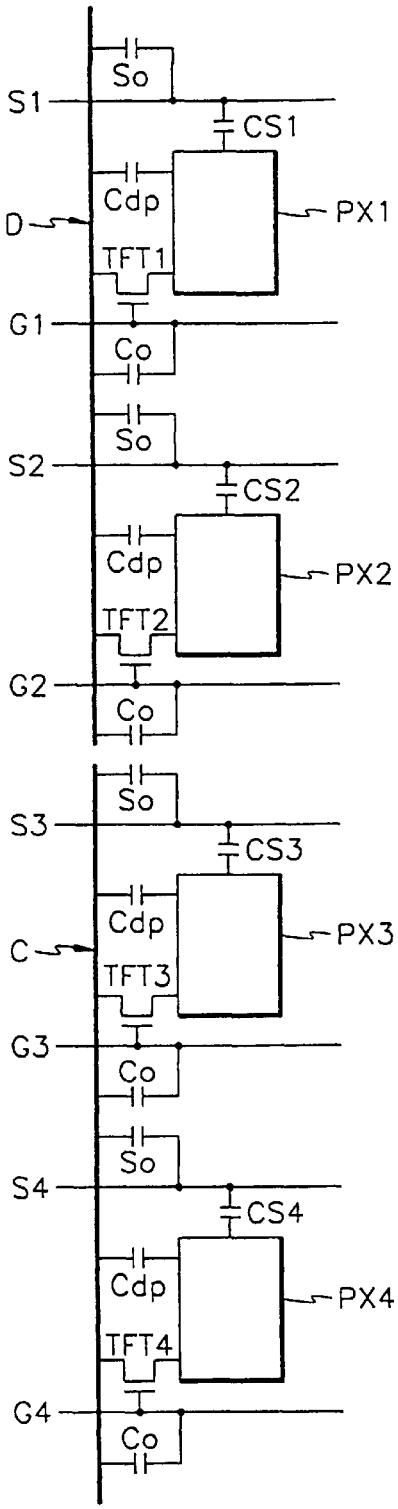

As shown in FIG. 6, upper and lower gate lines $G_1$, $G_2$, $G_3$ and $G_4$ are arranged in the transverse direction. Upper storage electrode lines, i.e., the first and the second storage electrode lines $S_1$ and $S_2$, and the lower storage electrode lines, i.e., the third and the fourth storage electrode lines $S_3$ and $S_4$ are arranged in the transverse direction. Each storage electrode line $S_1$, $S_2$, $S_3$ or $S_4$ is placed above each gate line $G_1$, $G_2$, $G_3$ or $G_4$. An upper data line D and a lower data line C are formed in the longitudinal direction.

Each pixel electrode PX1, PX2, PX3 or PX4 are connected to one of the storage electrode lines $S_1$, $S_2$, $S_3$ and $S_4$ via one storage capacitor CS1, CS2, CS3 or CS4. A gate electrode of a switching element TFT1, TFT2, TFT3 or TFT4 is connected to one of the gate lines $G_1$, $G_2$, $G_3$ and $G_4$, its source electrode connected to one of the data lines D and C, and its drain electrode connected to one of the pixel electrodes PX1, PX2, PX3 and PX4.

The upper data line D crosses the upper storage electrode lines $S_1$ and $S_2$ and the upper gate lines $G_1$ and $G_2$, while the lower data line C crossing the lower storage electrode lines $S_3$ and $S_4$ as well as the lower gate lines $G_3$ and $G_4$. In addition, the upper data line D is adjacent to the pixel electrodes PX1 and PX2 of the upper pixels, while the lower data line C being adjacent to the pixel electrodes PX3 and PX4 of the lower pixels.

Figure 7:
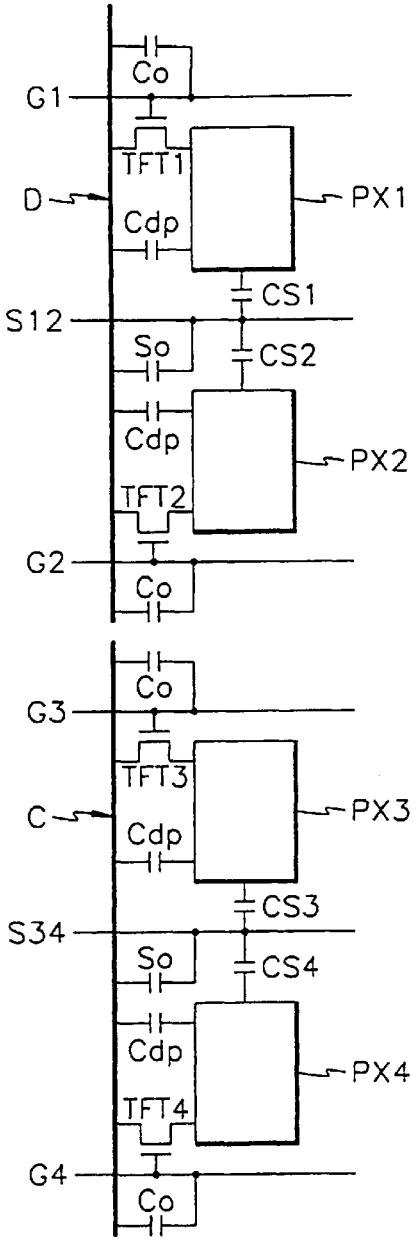

As shown in FIG. 7 showing another example in the independent wiring type, upper and lower gate lines $G_1$, $G_2$, $G_3$ and $G_4$ are arranged in the transverse direction. An upper storage electrode line $S_{12}$ and a lower storage electrode line $S_{34}$ are arranged in the transverse direction between odd gate lines $G_1$ and $G_3$ and the next event gate lines $G_2$ and $G_4$. The upper data line D and the lower data line C are formed in the longitudinal direction.

A pixel electrode PX1 or PX3 of the odd row pixel and a pixel electrode PX2 or PX4 of the next even row pixel are connected to the storage electrode lines $S_{12}$ or $S_{34}$ between the two pixel rows via one storage capacitor CS1, CS2, CS3 or CS4. A gate electrode of a switching element TFT1, TFT2, TFT3 or TFT4 is connected to one of the gate lines $G_1$, $G_2$, $G_3$ and $G_4$, its source electrode connected to one of the data lines D and C, and its drain electrode connected to one of the pixel electrodes PX1, PX2, PX3 and PX4.

The upper data line D crosses the upper storage electrode line $S_{12}$ and the upper gate lines $G_1$ and $G_2$, while the lower data line C crossing the lower storage electrode line $S_{34}$ as well as the lower gate lines $G_3$ and $G_4$. In addition, the upper data line D is adjacent to the pixel electrodes PX1 and PX2 of the upper pixels, while the lower data line C being adjacent to the pixel electrodes PX3 and PX4 of the lower pixels.

In the independent wiring type, examples of the capacitance contributing to the RC delay of the image signals flowing along the data lines are gate capacitances $C_0$ due to the overlap of the data lines and the gate lines, and pixel electrode capacitances $C_{dp}$ due to the overlap of the data lines and the pixel electrodes, as well as the storage electrode line capacitances $S_0$ due to the overlap of the data lines and the storage electrode lines. Another examples are capacitances between the data lines and a common electrode (not shown) of the other panel (not shown) and between the data lines and the switching elements.

As shown in FIG. 6, since the upper data line D and the lower data line C cross two gate lines and two storage electrode lines, respectively, and are adjacent to two pixel electrodes and to form the pixel electrode capacitors, respectively. Accordingly, both the capacitances of the image signal of the upper and the lower data lines D and C are ($2\ C_0+2\ C_{dp}+2\ S_0$), respectively, and thus equal to each other.

On the other hand, as shown in FIG. 7, since each data line D or C cross two gate lines $G_1$ and $G_2$ or $G_3$ and $G_4$ and one storage electrode lines $S_{12}$ or $S_{34}$, respectively, and is adjacent to two pixel electrodes PX1 and PX2 or PX3 and PX4 to form the pixel electrode capacitors, respectively. Accordingly, both the capacitances of the image signal of the upper and the lower data lines D and C are ($2\ C_0+2\ C_{dp}+S_0$), respectively, and thus equal to each other.

Therefore, in case of the independent wiring type, the capacitances loaded to the image signals in the upper and the lower data lines D and C are the same, as shown in FIGS. 6 and 7.

Now, a driving method of an LCD according to the present invention is described with reference to FIGS. 8 and 9 along with FIG. 2.

First, input image data of a frame A from outside enter the input buffer 50 in sequence. The image data from the input buffer 50 begin to be written and stored into the upper frame memory 42 at the time determined by a vertical and a horizontal synchronizing signal $V_{sync}$ and $H_{sync}$ and at a speed determined by a write clock signal WCK. The image data stored in the upper frame memory 50 would not be read until writing of upper data i.e., image data corresponding to the upper pixels is completed.

The moment lower data of the frame A, i.e., image data corresponding to the lower pixels begin to be written into the lower frame memory 44 in sequence from the (m+1)-th row pixel data, the upper data and the lower data begin to be read simultaneously from the frame memories 42 and 44. The image data are read in sequence from the image data corresponding to the first row pixels of both the upper pixels and the lower pixels, at a speed determined by the read clock signal RCK, and they enter the output buffers 32 and 34, respectively. The read clock signal RCK has a frequency half of the write clock signal WCK.

The image data stored in the upper and the lower output buffers 32 and 34 enter the upper and the lower data drivers 12 and 14, respectively.

At the same time, start signals STV1 and STV2 are applied to the upper gate driver 22 and the lower gate driver 24, respectively. Then, the gate drivers 22 and 24 supply scanning signals to ones of the upper gate lines and the lower gate lines, simultaneously. The scanning signals are applied in sequence from the first gate line $G_1$ and $G_{m+1}$ of both the upper and the lower gate lines, simultaneously. The period of the scanning signal is twice that of the scanning signal of the conventional LCD.

The upper data and the lower data from the upper and the lower data drivers 12 and 14 are applied to the upper pixels and the lower pixels supplied with the scanning signals via the upper data lines $D_1, \ldots, D_i$ and the lower data lines $C_i, \ldots, C_1$, respectively. Since the period of the scanning signal and the image data according to the present invention are twice those of the conventional LCD, the time for applying image data to the pixels is twice that of the conventional art.

The image data of a next frame B is written in the frame memories 42 and 44 after a time elapsed from the writing of the frame A is finished, and the reading of the upper data and the lower data of the frame A is finished before the writing of the upper data of the frame B is completed. The frame B begins to be read immediately after the writing of half of the frame B is completed as in case of the frame A.

Figure 8:
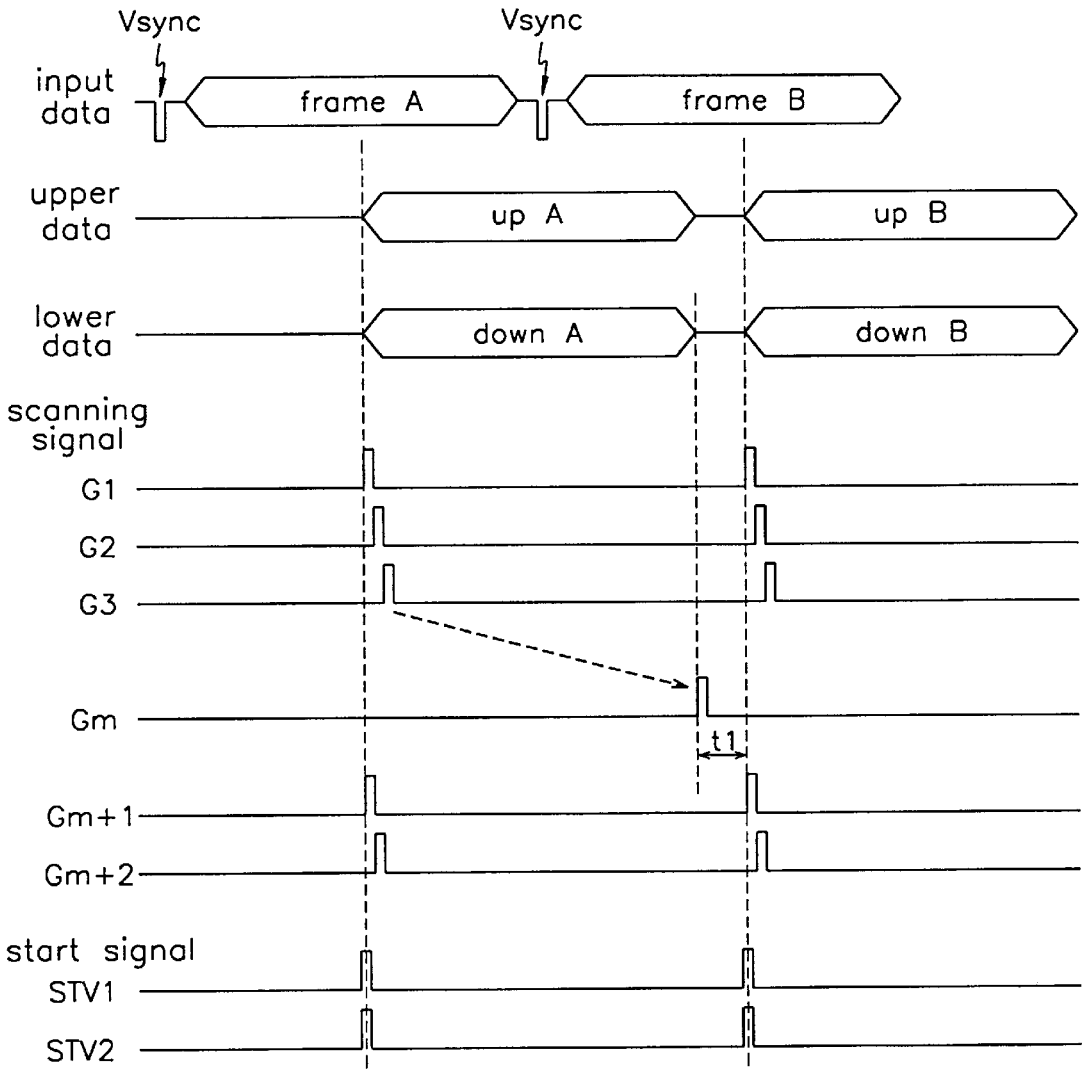
FIGS. 8 to 10 are timing charts illustrating the signals used in the first embodiment of the present invention.

On the other hand, although the upper and the lower data of a frame are simultaneously output immediately after the input of the upper data of the frame is finished, as shown in FIG. 8, the upper data may be output at an arbitrary time. For example, as shown in FIG. 9, the input and the output of the upper data of a frame begin at the same time, and the output of the lower data begins to be output immediately after the input of the half of the frame A is finished. In this case, the first start signal STV1 is applied to the upper gate driver 22 to start applying scanning signal to the gate lines from the first gate line $G_1$ the moment the frame A begins to be input, and the second start signal STV2 is applied to the lower gate driver 24 to begin to apply scanning signal to the (m+1)-th gate line $G_{m+1}$ immediately after the input of the half of the frame A is finished.

In addition, the simultaneous outputs of the upper data up A and the lower data down A begin at any time after the input of the half of the frame A is finished. One example is that when the frame B begins to be input after the input of the frame A is finished, the start signals STV1 and STV2 are simultaneously applied to the upper and the lower gate drivers 22 and 24, respectively, to begin to apply the upper and the lower data up A and down A to the corresponding pixels.

Figure 9:
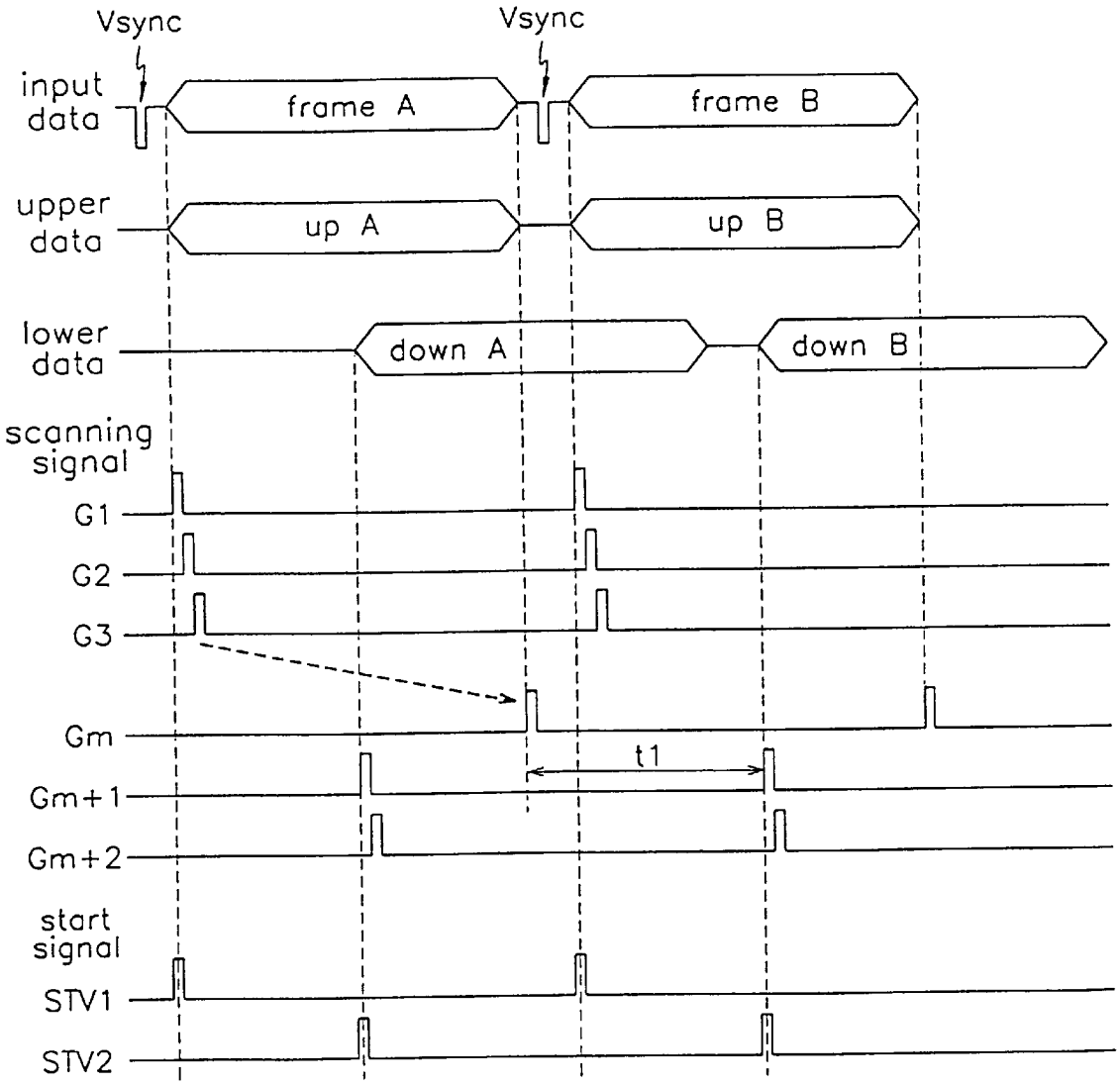
Figure 10:
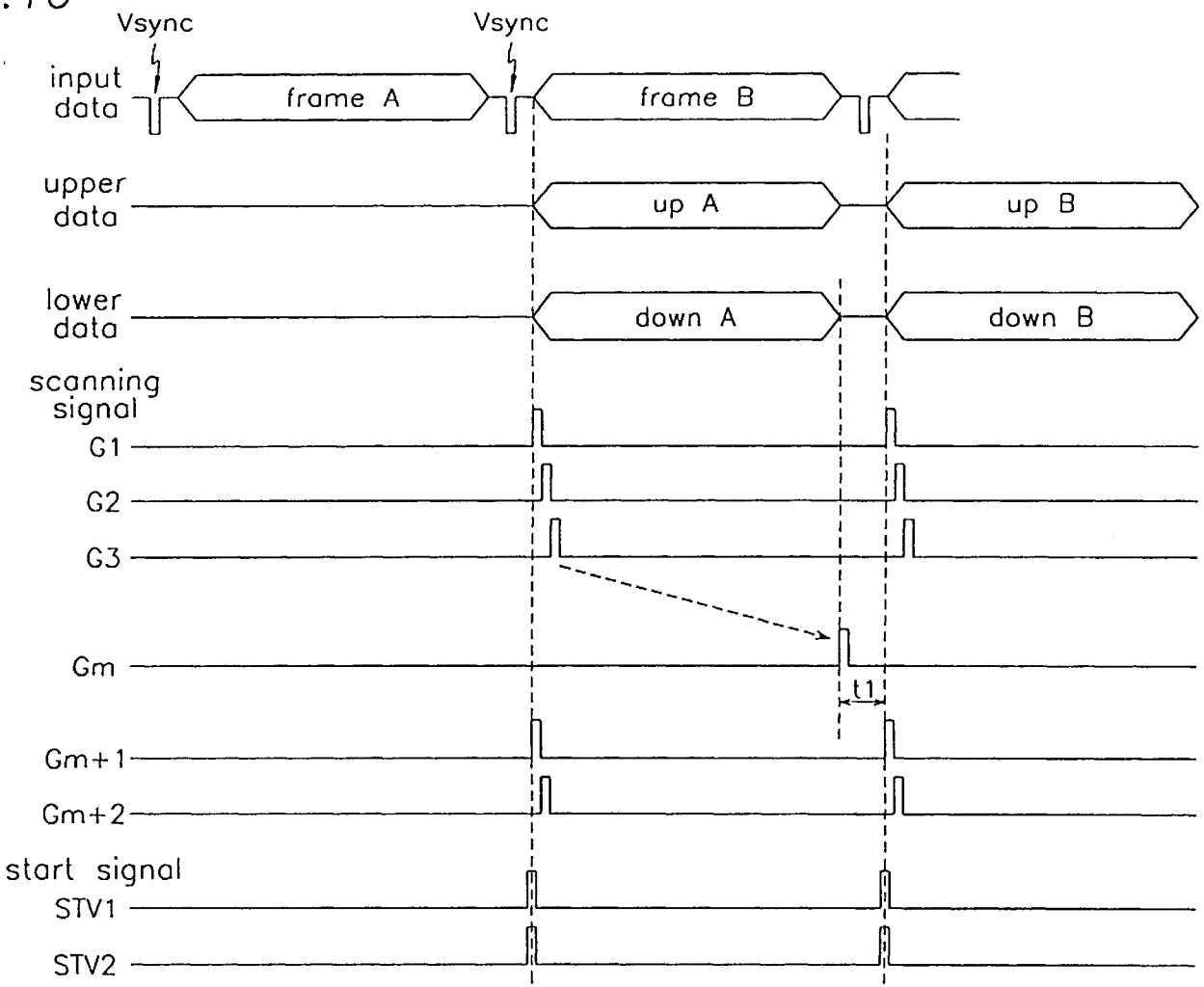

However, as shown in FIGS. 8 to 9. the image data of a frame corresponding to the (m+1)-th row pixels begins to be output after a time t1 is elapsed from the output of the image data of the previous frame corresponding to the m-th row pixels. This time t1 causes the holding ratio of the (m+1)-th row pixels to be different from the pixels in the other rows. Accordingly, there exists a problem that the brightness of the (m+1)-th row pixels is different from that of the pixels in the other rows.

Figure 11:
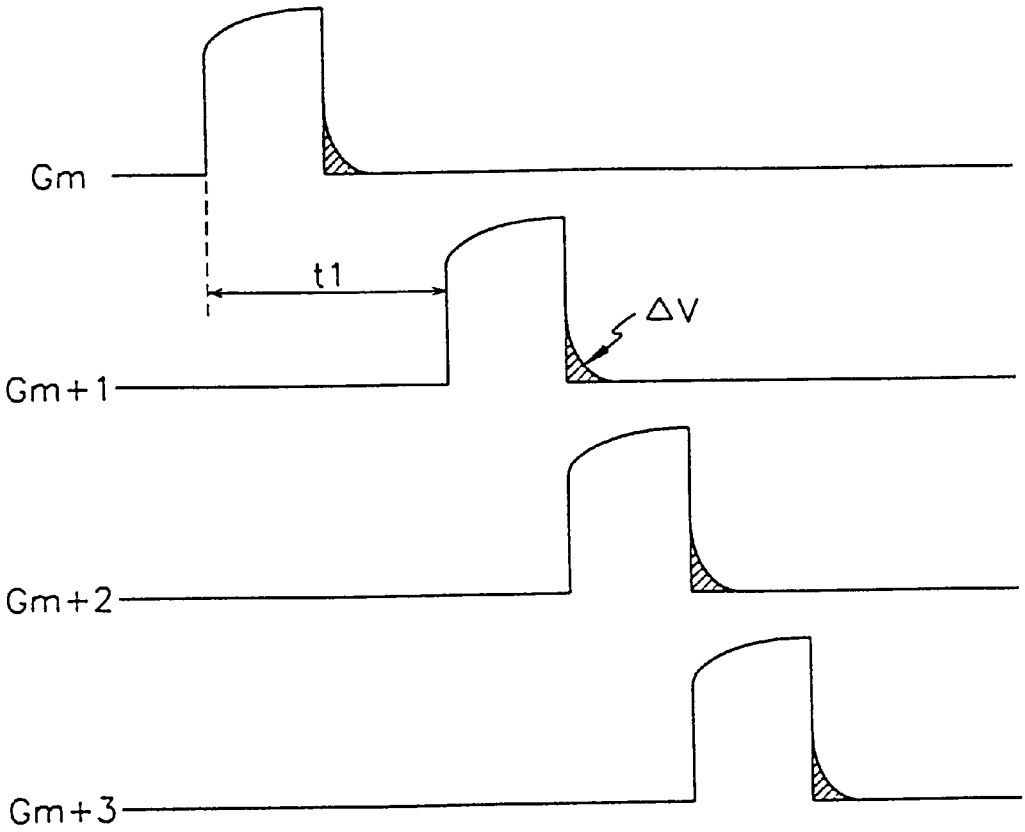
FIG. 11 is a timing chart illustrating the real scanning signal applied to the gate lines of the first embodiment of the present invention.

In addition, since the storage capacitors of the pixels are connected to the previous gate line in the case of the previous gate type, the their capacitances are combined with the resistances of the gate lines to cause RC delay in image signals. The real scanning pulses input into the gate lines are distorted as shown in FIG. 11, and the residual voltage $\Delta V$ remains for a time. The liquid crystal capacitor, consisting of a pixel electrode, a common electrode of the other panel and a liquid crystal therebetween, connected to the storage capacitor in parallel is charged on the basis of the potential of the previous gate line connected to the storage capacitor which has larger capacitance than the liquid crystal capacitor. Since all pixels except the m-th row pixels, i.e., the first row pixels to the m-th row pixels and the (m+2)-th row pixels to the last row pixels are sequentially and continuously charged respectively, the charging voltages into the pixels are reduced by the residual voltage $\Delta V$ as shown in FIG. 11. However, since there exists a time interval between the m-th scanning signal and the (m+1)-th scanning signal. That is, the (m+1)-th row pixels are charged when the previous m-th scanning signal is constant after the time the residual voltage $\Delta V$ remains is elapsed, the charging voltage of the (m+1)-th row pixels are not affected by the residual voltage $\Delta V$ of the previous scanning signal. Therefore, the (m+1)-th row pixels have different brightness from the pixels in the other rows even though they are applied with the same level of the image data.

Figure 12:
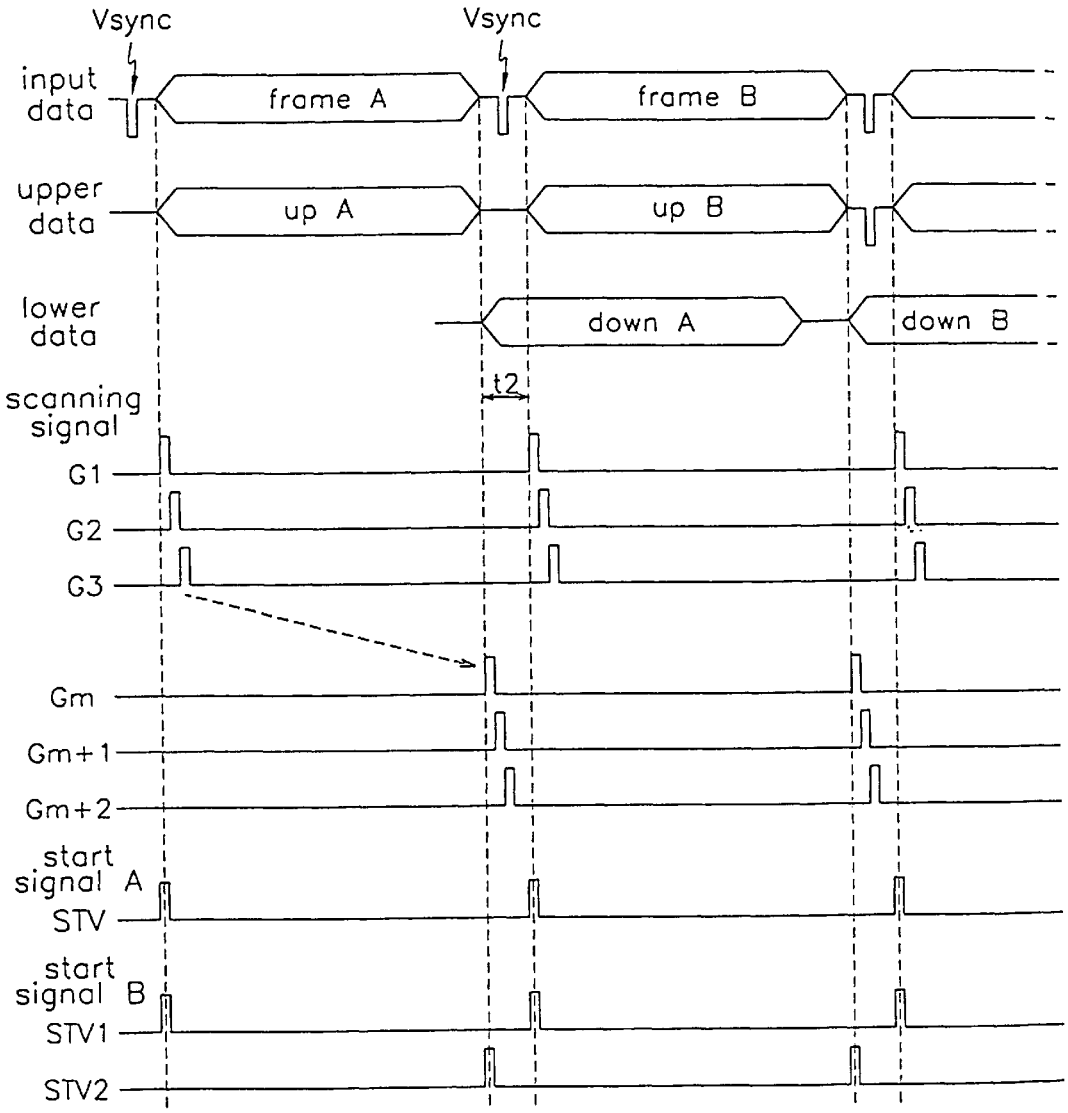
FIG. 12 is a timing chart illustrating the signals used in the second embodiment of the present invention.

In order to overcome this problem, the driving condition of the (m+1)-th row pixels should be the same as those of the pixels in the other rows. FIG. 12 shows an example.

The driving method of the LCD shown in FIG. 2 or 3 according to the second embodiments of the present invention is described with reference to FIG. 12.

It is noted that the LCD according to the second embodiment has a structure shown in FIG. 2 or 3. Although the LCD shown in FIG. 2 has two frame memories 42 and 44, one frame memory is sufficient for this embodiment. For convenience, this embodiment is described on the basis of the LCD shown in FIG. 3, and, if necessary, supplementary description will follow in case of the LCD shown in FIG. 2. In addition, the frame memories 42 and 44 in FIG. 2 are considered as a frame memory 40.

First, input data from outside enters the input buffer 50. The image data from the input buffer 50 begins to be written and stored in the memory 40 at the time determined by the vertical and horizontal synchronizing signal and at a speed determined by the write clock signal WCK. At the same time, the image data corresponding to the first row pixels begins to be read from the frame memory to enter the upper output buffer 32 at a speed determined by the read clock signal RCK.

At the same time, a start signal A STV is applied to the gate driver 20 and then, the scanning signal from the gate driver 20 is applied to the first gate line $G_1$. In case of the LCD shown in FIG. 2, a start signal B STV1 is applied to the upper gate driver 22 and then, the scanning signal is applied to the first gate line $G_1$.

Since the read clock signal RCK has a frequency half of the write clock signal WCK, the output of the upper data up A and the input of the frame A is finished simultaneously.

As soon as the output of the upper data up A is finished, the lower data down A stored in the frame memory 40 begins to be output. In case of the LCD shown in FIG. 2, a start signal B STV2 is applied to the lower gate driver 24 during the application of the m-th scanning signal, and thus a scanning signal is applied to the (m+1)-th gate line $G_{m+}$immediately after the application of the scanning signal to the m-th gate line $G_m$ is finished. Therefore, the output of the lower data down A follows the output of the upper data up A, and hence continuous application of the image data is realized.

After a time t2 is elapsed from the completion of the input of the frame A, the frame B begins to be input. At the same time, the start signal A STV or the start signal B STV1 is applied to the gate driver 20 or 22, and the upper data up B of the frame B begin to be input and output simultaneously.

As described above, since the image data corresponding to the first row pixels to the final row pixels are continuously applied to the pixels, all the pixels have the same driving conditions. Therefore, the method according to the second embodiment solves the problems in the first embodiment.

On the other hand, although the upper data up A are output at the moment the input of the frame A begin, and the lower data down A follows the output of the upper data up A as shown in FIG. 12, the upper data up A may be output at an arbitrary time. For example, after a time is elapsed from the beginning of the input of the frame A, the output of the upper data up A begins and is followed by the output of the lower data down A.

As described above, since the period of the scanning signal is twice that of the conventional scanning signal and the period of the image data is twice that of the conventional image data, the time for charging the pixels increases by twice the conventional art. In addition, since the image data of one frame is continuously applied to the pixels, the driving condition of each pixel is the same. Accordingly, the image quality is improved.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A circuit for driving an active matrix display including a plurality of pixels having switching elements, a plurality of first and second scanning lines and a plurality of first and second data lines, wherein the second data lines are located under the first data lines as a whole, the first and second data lines are coupled to the pixels via the switching elements and are disconnected from each other, and the first and the second scanning lines are respectively connected to the switching elements connected to the first and the second data lines, the circuit comprising:

a signal supplier for supplying scanning signals to one of the first scanning lines and one of the second scanning lines; and a data supplier for simultaneously supplying image data to the first and second data lines, wherein the scanning signals are respectively applied from uppermost lines of the first and the second scanning lines to lowermost lines of the first and the second scanning lines in sequence, and the scanning signal for the uppermost scanning line of the second scanning lines is applied immediately after the application of the scanning signal to the lowermost scanning lines of the first scanning line is finished.

2. The circuit of claim 1, wherein the signal supplier supplies first and second scanning signals, and wherein the signal supplier supplies an initial second scanning signal to an uppermost scanning line among the second scanning lines immediately after supplying a final first scanning signal to a lowermost scanning line among the first scanning lines.

3. The circuit of claim 2, wherein the scanning signals are applied to the one of the first scanning lines and the one of the second scanning lines at the same time.

4. A method for driving a matrix type display having a plurality of pixels arranged in a matrix type, each pixel connected to one of a plurality of scanning lines and one of a plurality of image signal lines, by applying scanning signals and image data to the pixels through the scanning lines extending in a transverse direction and the image signal lines extending in a longitudinal direction, respectively, wherein the scanning lines are divided into upper scanning lines and lower scanning lines, the image signal lines are divided into upper image signal lines and lower image signal lines, and the upper image signal lines and the lower image signal lines are disconnected from each other, the method comprising:

applying an upper scanning signal through the upper scanning lines connected to corresponding upper pixels;

applying upper image data to the corresponding upper pixels through the upper image signal lines simultaneously;

applying a lower scanning signal through the lower scanning lines connected to corresponding lower pixels;

applying lower image data to the corresponding lower pixels through the lower image signal lines simultaneously, wherein the scanning signals are respectively applied from uppermost lines of the first and the second scanning lines to lowermost lines of the first and the second scanning lines in sequence, and the scanning signal for the uppermost scanning line of the second scanning lines is applied immediately after the application of the scanning signal to the lowermost scanning lines of the first scanning line is finished.

5. The method of claim 4, wherein the upper and lower scanning signals are applied at the same time.

6. The method of claim 4, further comprising:

writing the upper image data corresponding to upper pixels connected to the upper scanning lines into a memory at a first speed;

writing lower image data corresponding to lower pixels connected to the lower scanning lines into the memory at the first speed;

supplying the scanning signals to the upper scanning lines in sequence, responsive to a first start signal;

supplying the scanning signals to the lower scanning lines in sequence, responsive to a second start signal;

reading the image data corresponding to the upper and lower pixels connected to the upper and lower scanning lines that are being supplied with the scanning signals, at a second speed from the memory in sequence; and applying the read image data to the corresponding pixels through the image signal lines, wherein the second speed is half of the first speed.

* * * * *